US008993983B2

(12) United States Patent
Li et al.

(10) Patent No.: US 8,993,983 B2
(45) Date of Patent: Mar. 31, 2015

(54) UV LED CURING APPARATUS WITH IMPROVED HOUSING AND SWITCH CONTROLLER

(75) Inventors: Yu-Jen Li, Taipei Hsieng (TW); Kuo-Chang Cheng, Taipei Hsieng (TW); Ya-Wen Wu, Taipei Hsieng (TW); Pei-Chen Yang, Taipei Hsieng (TW)

(73) Assignee: Nail Alliance LLC, Gladstone, MO (US)

( * ) Notice: Subject to any disclaimer, the term of this patent is extended or adjusted under 35 U.S.C. 154(b) by 877 days.

(21) Appl. No.: 12/779,779

(22) Filed: May 13, 2010

(65) Prior Publication Data

US 2011/0277338 A1 Nov. 17, 2011

(51) Int. Cl.

| | |
|---|---|
| ***G21K 5/08*** | (2006.01) |
| ***A45D 29/00*** | (2006.01) |
| ***F26B 9/00*** | (2006.01) |
| ***F26B 3/28*** | (2006.01) |

(52) U.S. Cl.

CPC . *F26B 9/003* (2013.01); *F26B 3/28* (2013.01); *A45D 29/00* (2013.01)

USPC ..... 250/455.11; 250/504 R; 250/492.1; 132/73; 34/277; 118/620; 118/641; 118/642; 425/174.4

(58) Field of Classification Search

CPC ... A45D 29/00; A45D 29/11; A45D 2029/00; A45D 2200/205; A45D 31/00; G21K 5/08

USPC ..... 250/455.11, 504 R, 504 H, 492.1; 132/73; 34/277; 118/620, 641, 642; 425/174.4

See application file for complete search history.

(56) References Cited

U.S. PATENT DOCUMENTS

| | | | | |
|---|---|---|---|---|
| 4,731,541 | A | 3/1988 | Shoemaker | |
| 4,988,883 | A * | 1/1991 | Oppawsky | 250/492.1 |
| 5,130,551 | A | 7/1992 | Nafziger | |
| 5,714,119 | A * | 2/1998 | Kawagoe et al. | 422/21 |
| 6,518,583 | B1 | 2/2003 | Hennig | |
| 6,753,536 | B2 * | 6/2004 | Humphreys et al. | 250/455.11 |
| 6,762,425 | B1 | 7/2004 | Strait | |
| 7,211,299 | B2 * | 5/2007 | Siegel | 427/493 |
| 7,835,057 | B2 * | 11/2010 | Kayser et al. | 359/246 |
| 8,142,052 | B2 * | 3/2012 | Wang et al. | 362/249.06 |
| 2008/0063809 | A1 * | 3/2008 | Lee et al. | 427/558 |

FOREIGN PATENT DOCUMENTS

| | | | |
|---|---|---|---|
| RU | 90301 | U1 * | 1/2010 |
| WO | WO 2005120286 | A1 * | 12/2005 |
| WO | WO 2007059813 | A1 * | 5/2007 |

* cited by examiner

*Primary Examiner* — Jack Berman

(74) *Attorney, Agent, or Firm* — Feldman Gale, PA; Walter C. Frank

(57) ABSTRACT

Nail gel curing devices emitting ultraviolet light, as well as methods of their making and use are disclosed. The devices are useful for curing, inter alia, acrylic compositions, more particularly, acrylic nail gel compositions, and typically employ ultraviolet and/or visible light emitting diodes ("LED") to cure such ultraviolet and/or visible light curable nail gel resins.

20 Claims, 6 Drawing Sheets

UV LED CURING APPARATUS WITH IMPROVED HOUSING AND SWITCH CONTROLLER

FIELD OF THE INVENTION

The present invention relates to an ultraviolet (UV) curing apparatus, and more particularly, to an UV light emitting diode (LED) curing apparatus utilizing an UV LED light source for solidifying an acrylic gel applied onto the nails of human fingers and toes in multiple at once and as well as those of animal pets.

BACKGROUND OF THE INVENTION

As solid state lighting or LED lighting is being widely adapted in various applications of lighting and is becoming one of the great solutions to a greener world. Among various types of LED, a new family of LED capable of emitting UV radiation or light in a shorter wavelength than the visible light, also known as UV LED, has been developed for industrial applications.

Despite the fact that UV rays can be harmful to the health of human in general since UV is more energetic than visible light and is therefore more dangerous, UV has its unique application in the industry. Certain industrial applications utilize UV rays for curing a specific liquid and such usage of UV has shown merits in printing techniques and creating of protective layers on industrial products. Conventional UV lamps have also been used to curing an acrylic liquid or gel in cosmetic applications to facilitate the creation of nail arts and nail protections.

Known UV devices for curing a specific UV hardening gel generally utilize traditional UV lamps and bulbs. U.S. Pat. No. 4,731,541 "Ultraviolet Light for use in Setting Gels for Artificial Fingernails" to Shoemaker discloses a UV device using traditional UV lamps for creating a protective layer on human hand nails by exposing the UV hardening gel coated on the nails under the lamp while allowing human hands to rest within the housing. U.S. Pat. No. 5,130,551 "Nail Drying Apparatus" to Nafzigar et al. adopts similar concepts of UV hardening gel and traditional UV lamps but with an improved design capable of receiving both the human hand and toe nails. U.S. Pat. No. 6,518,583 "Optical Exposure in particular a Table Lamp for Hardening Light-Hardening Gel in the courses of Fingernail Treatment" to Henning discloses a UV device for human hands that also utilizes traditional UV lamps but by using more UV bulbs, the UV lighting area is therefore increased to cover multiple fingernails at once. U.S. Pat. No. 6,762,425 "Portable Device for Curing Gel Nail Preparations" to Strait discloses a UV device for curing gel applied to the nails of both human hands and feet and as the UV compartment and lamps are designed specifically to treat both hands and feet received therein, Strait is able to harden the UV hardening gel applied to not just the nails of fingers but also toes at once.

One major concern to the use of such UV devices with human hands or feet is the hazard of having human skin exposed to UV rays under these traditional UV lamps or bulbs of the devices for a short or long period of time that may lead to undesirable skin cancer in a long run. Such hazard is also known to be closely related to the fact that traditional UV lamps typically emit three types of UV light in reference to skin protection and these are UVA, UVB, and UVC. Among the three rays, UVC is the most damaging and is the most energetic of the three types.

Furthermore, illuminating devices utilizing high power LED module, including UV LED module, shall provide a desired illumination onto a region covering for example multiple fingers or toes all at once while preventing undesirable UV light escaping out of the apparatus such that an UV hardening gel may be cured by the UV light effectively and safely.

In view of the foregoing, it is desirable to provide a UV curing device capable of overcoming the drawbacks of the known arts while providing a green solution to the environment with a greater safety to humans. Furthermore, it is also desirable to provide an UV curing device to facilitate the creation of nail arts and nail protections and in particular, an UV curing device capable of curing the nails of multiple fingers or toes all at once safely and effectively.

SUMMARY OF THE INVENTION

In order to overcome the shortcomings described above, one aspect of the present invention is to provide an UV LED curing apparatus capable of curing an UV LED hardening gel such as an acrylic gel by solidifying the gel from liquid to solid state with high safety and reliability.

Another aspect of the present invention is to provide an UV LED curing apparatus with an improved mechanical housing and lighting structure capable of providing both effective heat dissipation to high power UV LED modules utilized therein and proper reflection of UV light shone therefrom to cover a desired illumination area.

Still another aspect of the present invention is to provide an UV LED curing apparatus integrated with an enhanced electrical control including electronic components such as photo interrupter or photo sensor, timer and current regulator, capable of triggering and controlling the on-off state of the UV LED curing apparatus of the present invention automatically and efficiently.

A further aspect of the present invention is to provide an UV LED curing apparatus having a detachable outer casing capable of facilitating heat dissipation and air flow therein while allowing a greater user interaction to the selection and modifying of the outer appearance of the apparatus as both a decorative and protective means.

In one embodiment of the present invention, the UV LED curing apparatus comprises a light reflective inner casing enclosing an inner chamber or curing chamber having at least one front opening facing on a front side of the apparatus, an outer casing detachably attached to the inner casing, an UV LED light source comprising at least one UV LED module attached to the inner casing and having a light emitting side facing toward the inner chamber thereof, a switch controller comprising at least one button and a substrate, attached to the inner casing and electrically connected to the UV LED light source. The substrate of the switch controller is preferably integrated with a timer and a current regulator electrically connected to a photo interrupt module. During the operation of the apparatus, the switch controller controls an on-off state of the UV LED light source with reference to a first input signal received from and triggered by said photo interrupt module to turn on the UV LED light source and with reference to a second input signal received from the timer and the current regulator to turn off the UV LED light source. In other words, the UV LED curing apparatus of the present invention may be triggered to an on-state automatically to shine UV light onto an external object, such as multiple fingernails or toenails applied with an UV hardening gel all at once, in the inner chamber of the inner casing and may too be switched to an off-state automatically by the timer as a preset curing time lapses, such that the UV hardening gel on the nails may be cured or solidified automatically.

As the UV LED of the present invention may be of a selected range and may be controlled by the switch controller automatically, the UV LED of spectrum between 360 nm and 460 nm may preserve the safe use of UVA and UVB rays, UVA in particular, on human fingers and toes while the UV exposure time may too be optimally set for less than or equal to 30 seconds providing a safe, efficient and automatically-triggered curing of UV hardening gel on the nails of multiple fingers or toes all at once.

To allow greater user interaction and as a protective means, in one embodiment of the UV LED curing apparatus of the present invention, the outer casing may be configured to be detachably attached to the inner casing via any one of the following fixation means including screws, bolts and magnets, such that user may replace different outer casing with desired or prefabricated shapes for decorative and entertainment purposes. In addition to being a protective and decorative means, in another embodiment, the outer casing may further comprise at least one heat dissipating means, such as a rotary fan, electrically connected to the switch controller of the apparatus for further heat dissipation of the abovementioned inner casing and the UV LED light source attached thereon.

In another embodiment of the present invention, an UV LED curing apparatus of the present invention comprises a housing having an inner casing enclosing an inner or curing chamber having at least one front opening and an outer casing detachably attached to the inner casing, a reflector attached to the inner casing and comprising a plurality of light reflective planes angled from one another and a plurality of apertures formed thereon, an UV LED light source comprising at least one UV LED module affixed to the inner casing and positioned within the plurality of apertures of the reflector facing toward the inner chamber of the housing, a switch controller attached to the inner casing near a rear side of the housing opposite to said front side thereof and a power supply electrically connected to the UV LED light source and the switch controller, enclosed by the outer casing. The switch controller further comprises a photo interrupt module, a timer and current regulator electrically connected to each other and to the UV LED light source to control an on-off state of the UV LED light source with reference to a first input signal received from and triggered by said photo interrupt module to turn on the UV LED light source and with reference to a second input signal received from the timer and the current regulator to turn off the UV LED light source. In addition, the reflector attached to the inner casing of the housing and fitted to the inner chamber thereon may too direct and reflects UV light emitted from the UV LED light source within the inner chamber thereof while preventing the undesirable escape of the UV light out of the inner chamber and providing a wide angle of illumination, preferably covering an entire zone of such as a semi-sphere.

The abovementioned switch controller may allow the apparatus to have at least three modes of operation: standby mode, active mode and curing mode. Firstly, the switch controller may be activated from a standby mode to an active mode such that the photo interrupt module thereof is ready for transmitting the first input signal. As the switch controller is being activated to the active mode, it may remain active for a predetermined period of active time, for example 30 minutes, such that the photo interrupt module is ready to send said first input signal to the timer and the current regulator thereof to turn on the UV LED light source and to switch to the curing mode automatically. As the switch controller is at the curing mode and the UV LED light source is turned to an on-state after a predetermined period of curing time, for example 30 seconds, the switch controller is switched back to the active mode and the UV LED light source is turned to an off-state automatically. Lastly, as no further input signal is received from the photo interrupt module after the abovementioned active time during the active mode, the switch controller is returned to the standby mode for activation again to the active mode.

For greater portability of the apparatus of the present invention, in one embodiment, the UV LED curing apparatus may further comprise a portable power supply, such as rechargeable battery, electrically connected to the switch controller and the UV LED light source. In addition, the switch controller may also comprise a pulse-width modulation/PWM to enhance the control of the UV LED light source.

The foregoing summary recites preferred embodiments of the present invention and is for illustrative purposes. Embodiments of the present invention may be implemented in various different ways and shall too be considered as part of the present invention within its scope. Details of the exemplary embodiments of the present invention will be further described in the following.

BRIEF DESCRIPTION OF THE DRAWINGS

The present invention may be embodied in various forms and the details of the preferred embodiments of the present invention will be described in the subsequent content with reference to the accompanying drawings. The drawings (not to scale) show and depict only the preferred embodiments of the invention and shall not be considered as limitations to the scope of the present invention. Modifications of the shape of the present invention shall too be considered to be within the spirit of the present invention.

DESCRIPTION OF EMBODIMENTS OF THE INVENTION

Figure 1:
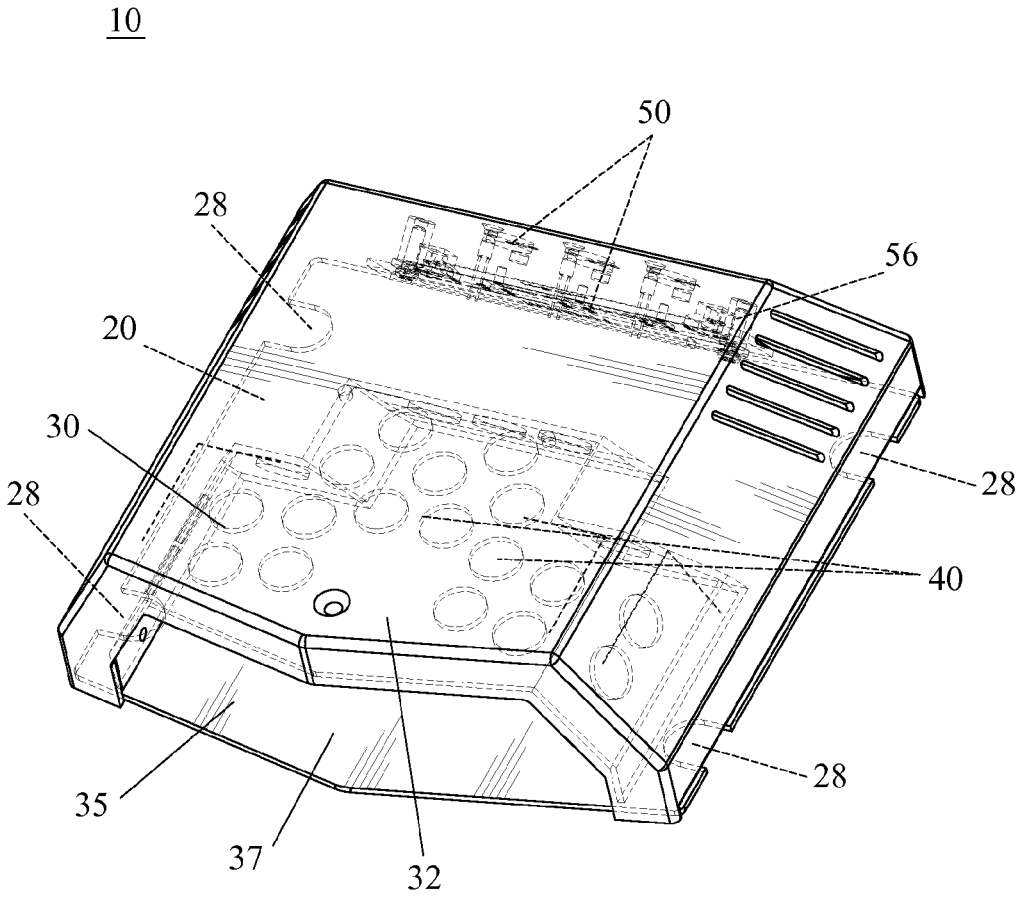
FIG. 1 is a front perspective view of an UV LED curing apparatus according to one embodiment of the present invention.
Figure 3:
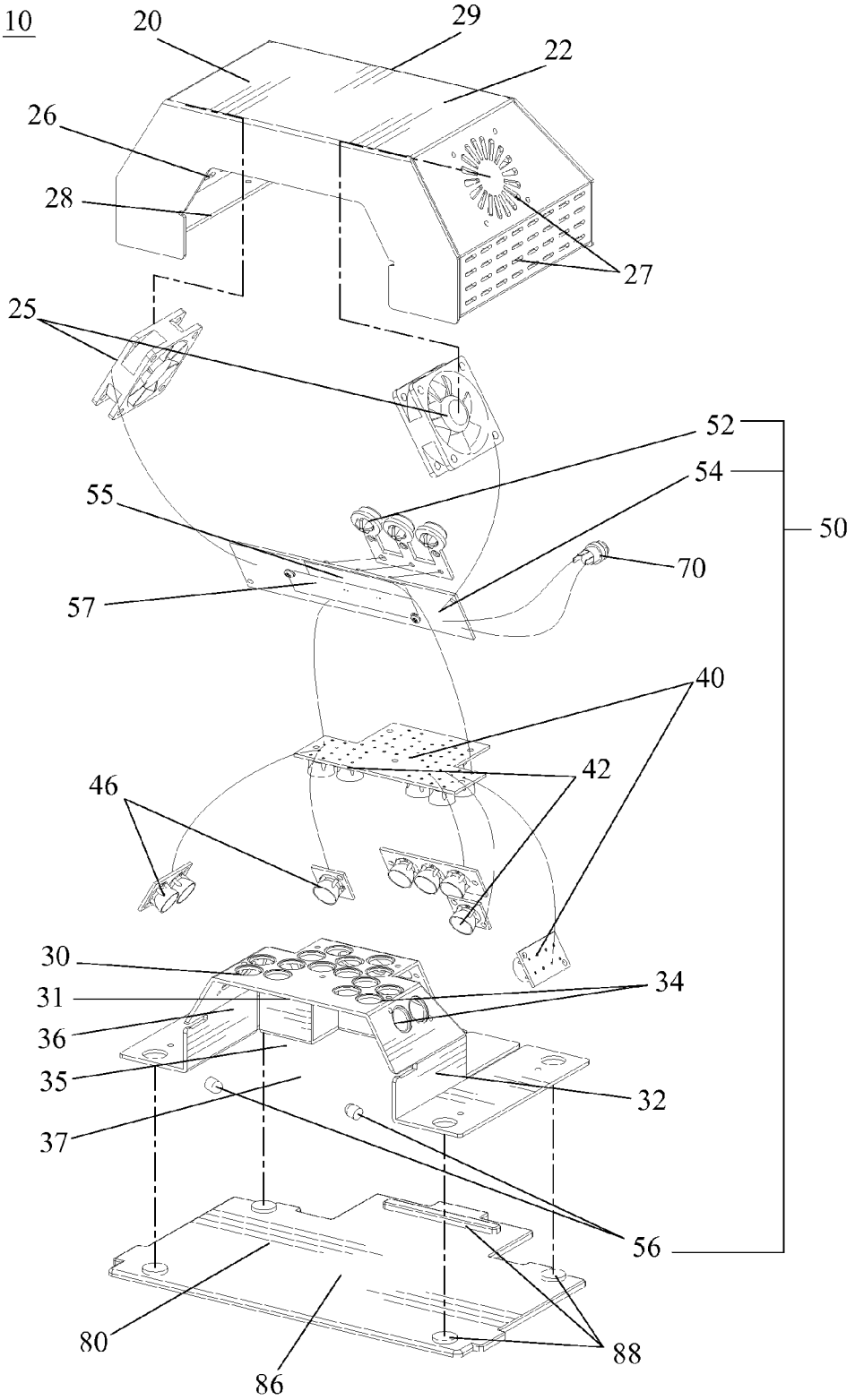
FIG. 3 is an exploded view of the UV LED curing apparatus of the present invention in FIG. 1.

FIGS. 1 and 3 show an explanatory embodiment of an UV LED curing apparatus 10 of the present invention, the UV LED curing apparatus 10 may provide UV LED light of desired wavelength(s) to objects applied with an UV hardening gel, in particular, such gel applied to the nails of multiple fingers or toes placed or received within the apparatus, for UV LED light curing to transform a liquid-phase gel to a solid-phase layer. In one embodiment as shown in the figures, the UV LED curing apparatus 10 comprises a light reflective inner casing 30 having a light reflective inner wall 36 enclosing an inner chamber 35 and an outer wall 32; wherein the inner or curing chamber 35 includes at least one front opening 37 facing toward a front side of the apparatus 10 and an outer casing 20 detachably attached to the outer wall 32 of the inner casing 30 via fixation means 28 such as screws, bolts and magnets. The inner casing 30 may advantageously serve as both a light reflector and a supporting substrate for an UV LED light source 40; whereas the detachable outer casing 20 may be provided to advantageously allow greater user interactions for entertainment purposes in addition to being a protective means, as illustrated in the later content.

The UV LED curing apparatus 10 may further comprise an UV LED light source 40 comprising at least one UV LED module 42 affixed to the inner casing 30 and having a light emitting side D facing toward the inner chamber 35 thereof. The UV LED modules 42 may be preferably attached to the outer wall 32 of the inner casing 30; wherein the inner casing 30 may be further formed of a plurality of apertures 34 to receive said UV LED modules 42 therein such that the light emitting side D of the UV LED module 42 may be positioned corresponding to these apertures 34 and allowing UV light emitted from the UV LED modules 42 to be directed toward the inner chamber 35 of the inner casing 30. Furthermore, in one embodiment, the UV LED light source may be of a short wavelength between 360 nm and 460 nm; in a preferred embodiment, the UV LED module 42 of the light source 40 may be pre-selected to be 405 nm Furthermore, the UV LED module 42 of the UV LED light source 40 may further comprise a collimator 46 attached to the light emitting side D thereof to facilitate the focus and direction of the UV light emitted therefrom. In a preferred embodiment, the collimator 46 may be a plano-convex lens having a convex light output surface to direct UV light entered. The UV LED module or LED emitter may be a lamp-type LED, SMD-type LED or can-type LED; preferred examples of UV LEDs include Nichia UV LED model NSPU510CS, NCSU033A, NSHU591B. It can be understood that other UV LEDs capable of curing an UV hardening gel such as acrylic gel may be used. The UV hardening gel may transform from a liquid-like state to a solid state while being exposed to UV rays; in addition, the UV LED hardening gel may undergo such phase change of solidification within 30 seconds of time subject to the UV LED light.

Figure 2:
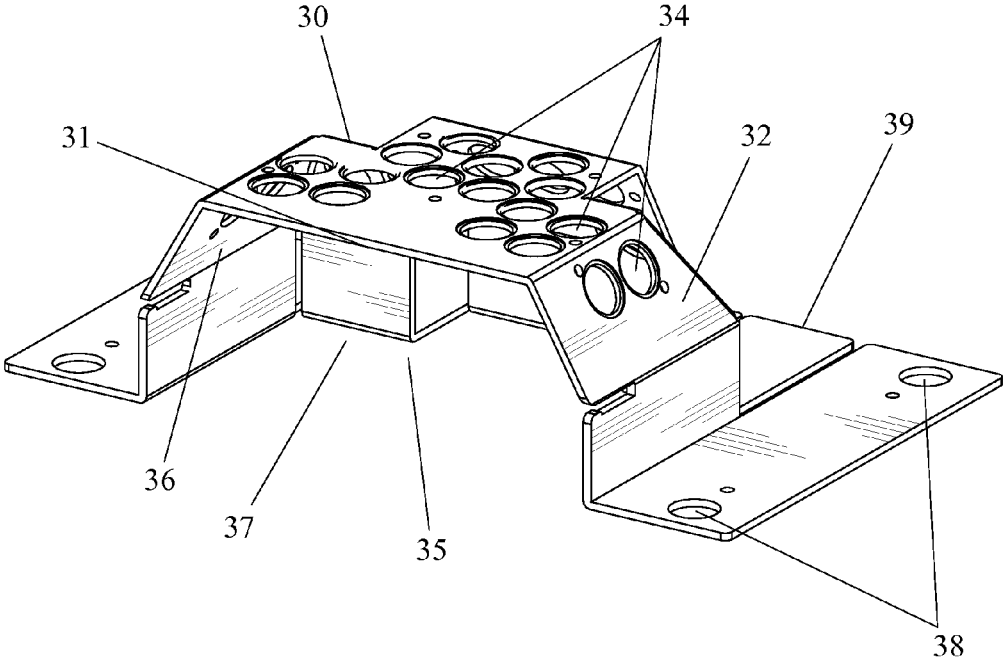
FIG. 2 is a front perspective view of a preferred embodiment of a light reflective inner casing of the UV LED curing apparatus in FIG. 1.

FIG. 2 shows an explanatory embodiment of the inner casing 30 of the UV LED curing apparatus 10 of the present invention. In one embodiment, the inner casing 30 may be prefabricated by a sheet metal to form a structure that is cost effective and durable to support said UV LED light source 40 attached thereon and to serve as a reflector to reflect UV light within said inner or curing chamber 35 thereof. A plurality of apertures 34 may be formed on the outer wall 32 of the inner casing 30 to facilitate the positioning and attachment of the UV LED modules 42 of the UV LED light source 40 thereon correspondingly. The size of the aperture or hole 34 is preferably configured to be substantially equal to the ones of the UV LED modules 42, or to the one of the abovementioned collimator 46 provided thereon, to prevent undesirable leakage of UV light to other parts of the housing or the environment other than the intended illuminating area of the inner or curing chamber 35. The inner wall 36 of the inner casing 30 is preferably to be of a reflective surface or property; in one embodiment, the inner wall 36 may be coated with a reflective layer made from any one of the following metal alloys: silver, nickel, cobalt, aluminum and combinations thereof to reflect UV light, that are non-toxic and responsive to UV light in terms of reflection. As shown in the figure, the front side 31 of the inner casing 30 may be aligned with the front side of the apparatus and may further include a front opening 37 such that user's fingers or toes may be received in the inner chamber 35 for the UV LED light curing on the UV hardening gel applied thereon. The rear side 39 of the inner casing 30 may be configured to receive a switch controller 50 including start button and control buttons as well as circuit board. Furthermore, the inner casing 30 may be further provided with fixation means 38 such that the abovementioned outer casing 20 may be attached to the inner casing 30 via for example, screws, bolts and magnets According to one embodiment of the present invention, the inner casing 30 of the apparatus 10 may be formed of a plurality of surfaces as shown in FIG. 2. The inner wall 36 of the inner casing 30 may comprise a plurality of planes angled from one another such that the UV light may be reflected and directed within the inner chamber 35 to provide a desired illumination. In a preferred embodiment, the planes may be angled from one another at an angle between 90 degree and 175 degree; in one particular example, the angle between any two adjacent planes thereof may be 120 degree, such that the UV LED modules 42 of the UV LED light source 40 having a light emitting side D facing toward the inner chamber 35 of the inner casing 30 may provide an uniform illumination in the inner chamber 35.

As shown in FIG. 3, the outer casing 20 of the apparatus may be provided as a protective means and a decorative means detachably attached to the abovementioned inner casing 20 to allow greater user interactions and for entertainment purposes. In one embodiment, the outer casing 20 may further comprise at least one heat dissipating means 25 disposed between the outer casing 20 and the inner casing 30 for dissipating heat generated by the UV LED light source 40 away therefrom. In a preferred embodiment, the heat dissipating means 25 may be a rotary fan electrically connected to a switch controller 50 and activated by said first input signal from a photo interrupt module thereof; further details is to be provided in the later content. The outer casing 20 may be further provided with heat dissipating vents 27 to facilitate the air flow therethrough. In one embodiment, the outer wall 22 of the outer casing may include a flat top to allow user resting hands or feet thereon, especially, during the application and curing of the UV hardening gel applied onto the nails of the fingers or toes. The inner wall 26 may be further provided with attachment means (not shown) such as magnets to facilitate the attachment to the inner casing 30. As mentioned previously, the fixation means 28 may be provided on the outer casing to facilitate the attachment to the inner casing 20 via for example screws, bolts and magnets. According to one embodiment of the present invention, the outer casing 20 may further include a bottom cover 80 having fixation means 88 detachably attached to the inner casing 30 via for example screws, bolts and magnets. In another embodiment, the bottom cover 80 may be detachably attached to the outer casing 20 via the inner casing 30, in particular via the fixation means 38 of the inner casing; in a specific example, the fixation means 38 may also be through holes such that the outer casing 20 may be attached to a bottom cover 80 directly. In still another embodiment, the upper surface 86 of the bottom cover 80 may too be of a reflective surface or may be further coated with a reflective material or metal alloys such as silver, nickel, cobalt, aluminum and combinations thereof to facilitate the reflection of the UV light within the inner or curing chamber 35 of the inner casing 30 or housing.

The UV LED curing apparatus 10 of the present invention further comprises a switch controller 50. As shown in FIG. 3, in one embodiment, the switch controller 50 may further comprise at least one button 52, a substrate 54 and a photo interrupt module 56. The switch controller 50 may be preferably attached to the inner casing 30 and electrically connected to the UV LED light source 40. Furthermore, the substrate 54 of the switch controller may further include a timer 55 and a current regulator 57 integrated thereon and electrically connected to the photo interrupt module 56. The buttons 52 may be start button and/or press buttons electrically connected to the substrate 52 and the photo interrupt module 56 may be photo sensors having an emitter and a receiver to detect an interrupt signal. In one embodiment, said buttons 52 and the substrate 52 are preferably arranged on the rear side of 39 of the inner casing and provided on the rear side of the apparatus; whereas the photo interrupt module 56 may be preferably provided adjacent to the front opening 37 of the inner casing 30. It can be understood that the photo interrupt module 56 may too be provided on any location or spot of the inner wall 36 of the inner casing 30 and preferably within the inner chamber 35 to detect an interrupt signal triggered by for example the insertion of user's hand or foot into the inner chamber 35 via the front opening 37 thereof.

Figure 4:
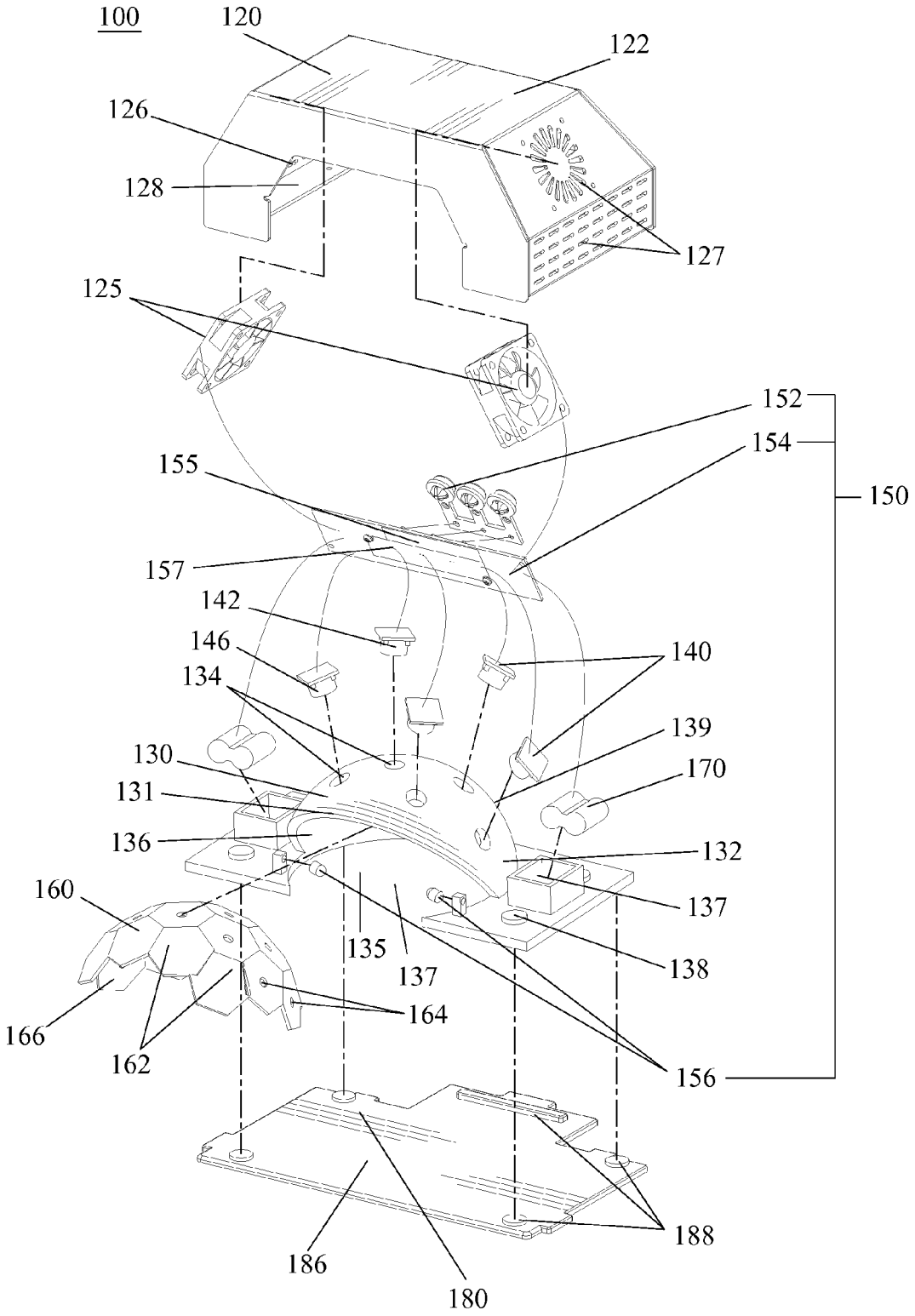
FIG. 4 is an exploded view of the UV LED curing apparatus according to another embodiment of the present invention.

FIG. 4 shows another explanatory embodiment of an UV LED curing apparatus 100 of the present invention. The UV LED curing apparatus 100 may too be used for curing an UV hardening gel applied onto for example multiple fingernails or toenails. In one embodiment, the UV LED curing apparatus 100 comprises a housing including an inner casing 130, an outer casing 120 detachably attached to the inner casing 130, a reflector 160 capable of reflecting UV light and attached to the inner casing 130, an UV LED light source 140 affixed to the inner casing 130 and a switch controller 150 electrically connected to the UV LED light source 140 and capable of controlling on/off states of the UV LED light source 140 of the apparatus automatically. As the UV hardening gel is being subject to the UV light emitted from the UV LED light source 140 of the apparatus, particularly within the inner casing 130 thereof, the UV hardening gel may be cured and solidified from a liquid phase to a solid phase such that a decorative and/or protective layer of the gel may be formed.

According to one embodiment of the present invention, the inner casing 130 may be of a dome or semi-dome shape enclosing an inner chamber 135 having a front opening 137 formed on a front side 131 of the housing. The outer wall 132 of the inner casing 130 of the housing may be formed of a plurality of light holes 134 provided for the positioning and attachment of the UV LED modules of the abovementioned UV LED light source 140 thereon. The inner wall 136 of the inner casing 130 of the housing may be attached to and provided with the abovementioned reflector 160 to facilitate the reflection of the UV light within the inner or curing chamber 135 thereof. The inner casing 130 may be detachably attached to the outer casing 120 via fixation means 138 including for example, screws, bolts and/or magnets. In addition, the front opening 137 of the inner chamber 135 may be configured to receive external objects such as user hand or foot for UV LED light illumination within the inner chamber 135. The inner casing 130 may be of multipurpose to serve as a supporting structure for the UV LED light source 140, a heat dissipating means to facilitate the heat conduction away from the light source 140 during operation and an UV light enclosure for the reflector 160. It can also be understood that other shapes of the inner casing 130 and the inner chamber 135 thereof may too be possible.

Likewise, in one embodiment, the detachable outer casing 120 of the UV LED curing apparatus 100 may further comprise at least one heat dissipating means 125 such as a rotary fan. The heat dissipating fan 125 may be electrically connected to a power supply 170 as shown in FIG. 4 and may preferably be activated by the abovementioned switch controller 150 automatically. As the additional heat dissipating fan 125 may be disposed between the outer casing 120 and the inner casing 130, the heat generated by the UV LED light source 140 during operation may be effectively dissipated to the ambient as the air flow through the vents 127, provided on the outer wall 122 of the outer casing 120, may be enhanced. As mentioned previously, the outer casing 120 of the housing may be attached to the inner casing 130 of the housing detachably, the outer casing 120 may also include fixation means 128 positioned in correspondence to the fixation means 138 of the inner casing 130; furthermore, the inner wall 126 of the outer casing 120 may too be further provided with for example magnets (not shown), such that the outer casing 120 may be detachably attached to the inner casing 130 of the housing by any one of the fixation means 128, 138 including screws, bolts and magnets. In a preferred embodiment, the outer casing 120 may too include a flat top portion to allow user resting his or her hand or foot thereon during the nail curing process. In another preferred embodiment, the housing or the outer casing 130 may further include a bottom cover 180 positioned beneath the inner casing 130 and may too be detachably attached to the inner casing 130 via fixation means 188 and the ones of the inner casing 130 and outer casing 130. In another embodiment, the bottom cover 180 may be configured to be attached to the outer casing 120 directly via the fixation holes 138 of the inner casing 130. It too can be understood that other forms and shapes of the casing are possible.

As shown in FIG. 4, the reflector 160 may be attached to the inner casing 130 to enhance the reflection and illumination of the UV light emitted from the UV LED light source 140 within the inner chamber 135 of the inner casing 130 of the housing. In one embodiment, the reflector 160 may comprise a plurality of light reflective planes 162 angled from one another and a plurality of apertures 164 formed thereon and the reflector 160 may be preferably attached to the inner casing 130 and fitted to the inner chamber 135 thereof and the housing. The inner surface 166 of the reflector 160 may preferably be a reflective surface capable of facilitate the reflection of UV LED light and may be made of or coated with a material or metal alloys such as silver, nickel, cobalt, aluminum and combinations thereof. Likewise, in one embodiment, the abovementioned bottom cover 180 of the housing may too include a reflective top surface 186 to enhance the reflection of the UV light. Furthermore, the light reflective planes 162 of the reflector 160 may be angled from one another at an angle between 90 degree and 175 degree; in other words, any two adjacent planes 162 may be angled from each other at an angle between 90 and 175 degree and preferably between 100 and 130 degree.

The UV LED light source 140 may also comprise a plurality of UV LED modules 142 affixed to the inner casing 130 and preferably positioned within the plurality of apertures 164 of the reflector 160. The light emitting side of the UV LED modules 142 and the UV LED light source 140 is preferably arranged to be facing toward the inner chamber 135 of the inner casing 130 and the housing. In one embodiment, the UV LED modules 142 are scattered and disposed on the inner casing such that wide angle and coverage of UV illumination may be achieved within the inner chamber 135.

To enhance the portability of the UV LED curing apparatus 100 of the present invention, in one embodiment, the UV LED curing apparatus 100 may further comprise a power supply 170 that may preferably be built in the apparatus. The power supply 170 may be for example rechargeable battery electrically connected to the UV LED light source 140 and the switch controller 150 of the apparatus. As shown in FIG. 4, in a preferred embodiment, the power supply in a form of rechargeable battery 170 may be attached to the inner casing 130 and enclosed by the outer casing 120. In another embodiment, the power supply 170 may include both an electrical plug for direct AC power connection and DC rechargeable batteries.

The switch controller 150 of the UV LED curing apparatus 100 may comprise at least one button 152, a substrate 154 and a photo interrupt module 156. In one embodiment, the buttons 152 and the substrate 154 may be arranged to be on a rear side 139 of the housing opposite to said front side 131 thereof and electrically connected to the UV LED light source 140; whereas the photo interrupt module 156 may be disposed adjacent to the front opening 137 of the inner chamber 135 of the housing. The substrate 154 may preferably include a timer 155, a current regulator 157 integrated thereon to control of an on-off state of the UV LED light source 140 electrically connected thereto. According to a preferred embodiment of the present invention, the photo interrupt module 156 of the switch controller 150 may include at least one sensor emitter having an active side facing toward the front opening 137 of the inner chamber 137 of the inner casing 135 and the housing such that the photo interrupt module 156 may be triggered with reference to an interrupt signal from the at least one sensor emitter. With reference to FIG. 4, the sensor emitter and/or receiver of the photo interrupt module 156 is attached to the inner casing 130 and positioned at the lateral sides of the front opening 137 thereof for detection of interrupt signal; nevertheless, it can be understood that the photo interrupt module 156, possibly including more than one sensors, may too be provided on any location or spot of the inner chamber 135 of the inner casing 130 to detect an interrupt signal triggered by for example the insertion of user's hand or foot into the inner chamber 135 via the front opening 137 thereof.

During the curing operation, user may place his or her hand or foot in the inner chamber of the UV LED curing apparatus of the present invention such that the UV hardening gel, such as acrylic type UV gel, applied onto multiple nails may be cured and solidified. As the apparatus is electrically connected to the power supply and at an initial on-state, the photo interrupt of the switch controller is also preferably activated and stayed on at an "active mode" continuous for a certain period of listening time preset by the abovementioned timer and current regulator of the switch controller, waiting to receive an interrupt signal or first input signal to be sent and triggered by the external user's action of insertion into the inner chamber of the apparatus. The failure to receiving any interrupt signal from the photo interrupt module triggered by the user during such preset period of listening time in the active mode, the switch controller may set the apparatus to be at an inactive state or "standby mode" that may only be re-activated by a start signal received from a start button. Once the user hand or foot is inserted into the apparatus and the interrupt or first input signal is triggered or sent from the photo interrupt, the switch controller then sets the apparatus to be at a "curing mode" and simultaneously, the UV LED light source is being activated to an on-state by the switch controller to shine UV light within the inner chamber.

According to one preferred embodiment of the present invention, the timer and the current regulator of the switch controller also include a preset period of curing time such that the UV LED light source may be controlled and turned to an off-state automatically with reference to such preset of curing time as a time-up signal or second input signal is sent by the timer and the current regulator of the switch controller to off the UV LED light source, ensuring an efficient and safe curing of the apparatus. Once the curing time lapses and the time-up signal is received, the switch controller sets the apparatus to turn to the abovementioned active mode again waiting for another interrupt signal to be triggered and sent by the photo interrupt module. In other words, the switch controller provides an automatic control of the UV LED curing apparatus of the present invention such that the apparatus may be activated automatically following user's insertion of hand or toe applied with an UV hardening gel on the nails thereof into the curing chamber or inner chamber and the UV light from the UV LED light source may be turned off automatically once the preset curing time lapses.

Figure 5:
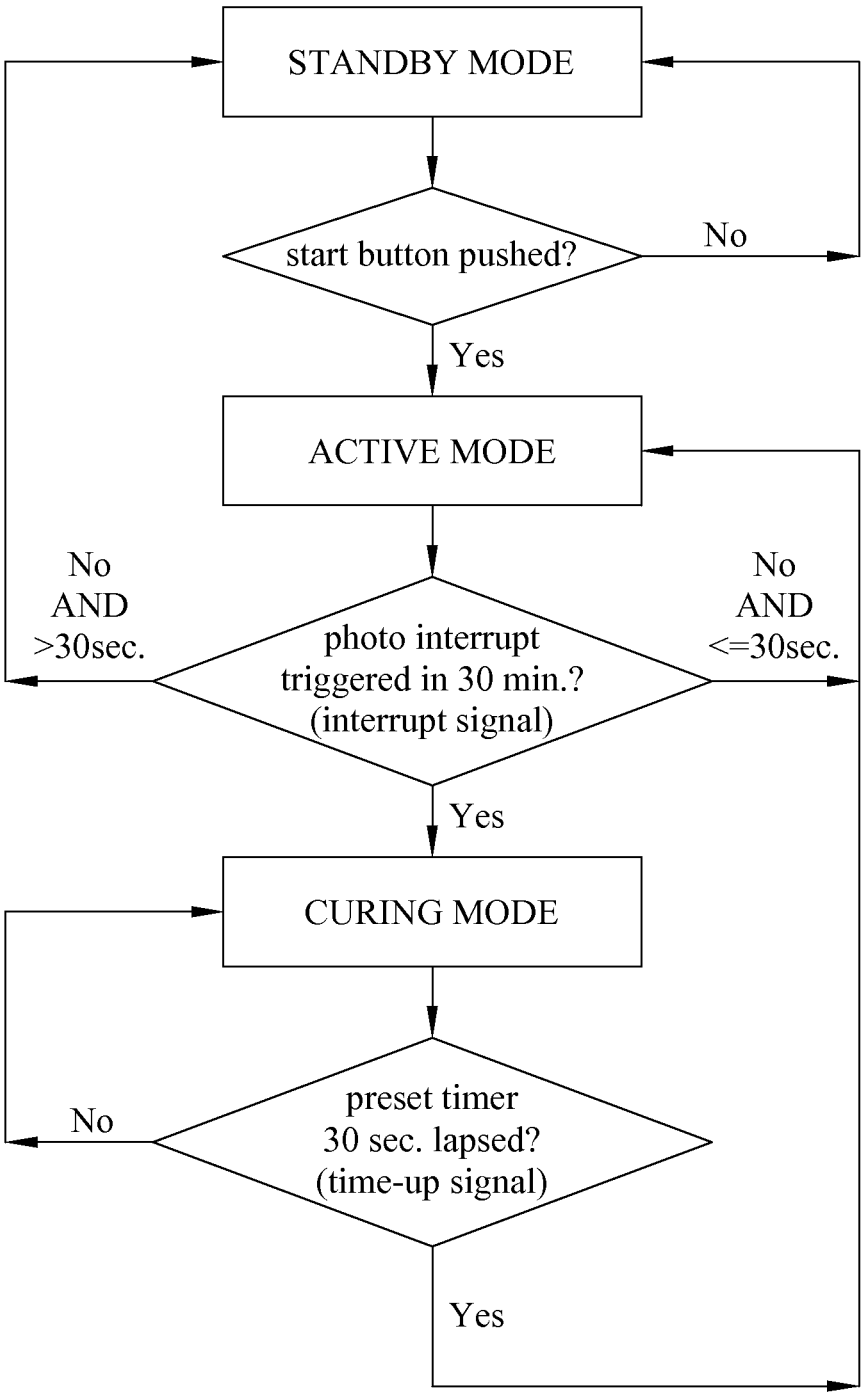
FIG. 5 shows an illustrative functional block diagram of a switch controller of the UV LED curing apparatus according to one embodiment of the present invention.

Accordingly, FIG. 5 shows an explanatory functional flowchart of a switch controller of the UV LED curing apparatus according to one embodiment of the present invention. As recited above, the UV LED curing apparatus of the present invention may preferably be set to three modes of operation: standby mode, active mode and curing mode. In general, each mode of operation may be distinct from one another depending upon the status from switch controller to the UV LED light source and the photo interrupt module in particular. As the apparatus is at the standby mode, the photo interrupt module of the switch controller and the UV LED light source are both at off-state. Once the abovementioned start signal is sent to the switch controller triggered by such as the start button, the apparatus is switched to the active mode in which the photo interrupt module is at on-state but the UV LED light source remains at off-state. If the photo interrupt fails to detect any interrupt or no interrupt signal (first input signal) is being sent to the switch controller within the abovementioned preset period of listening time, the apparatus is once again returned to the standby mode. In a preferred embodiment, the period of listening time may be preferably set to be any period between 5 to 60 minutes, such as 30 minutes, for power saving and efficiency purposes; any other preset time may too be possible. As the photo interrupt module detects an interrupt, the interrupt signal is sent to the switch controller switching the apparatus to the curing mode in which the photo interrupt module of the switch controller is turned off and the UV LED light source is switched to an on-state for shining UV light into the curing or inner chamber of the housing. As shown in the figure, the period of curing time may be preset in the timer of the switch controller such that once the curing time lapses, the abovementioned time-up signal (second input signal) is sent to the switch controller to switching the apparatus back to the active mode again for the photo interrupt to listen to another interrupt. In a preferred embodiment, the curing time of a clock circuitry present in the timer of the switch controller may be preset to be any length of time greater than 5 seconds, preferably 30 seconds. In short, the switch controller may control an on-off state of the UV LED light source with reference to said first input signal received from and triggered by said photo interrupt module to turn on the UV LED light source and with reference to said second input signal received from the timer and the current regulator to turn off the UV LED light source.

Figure 6:
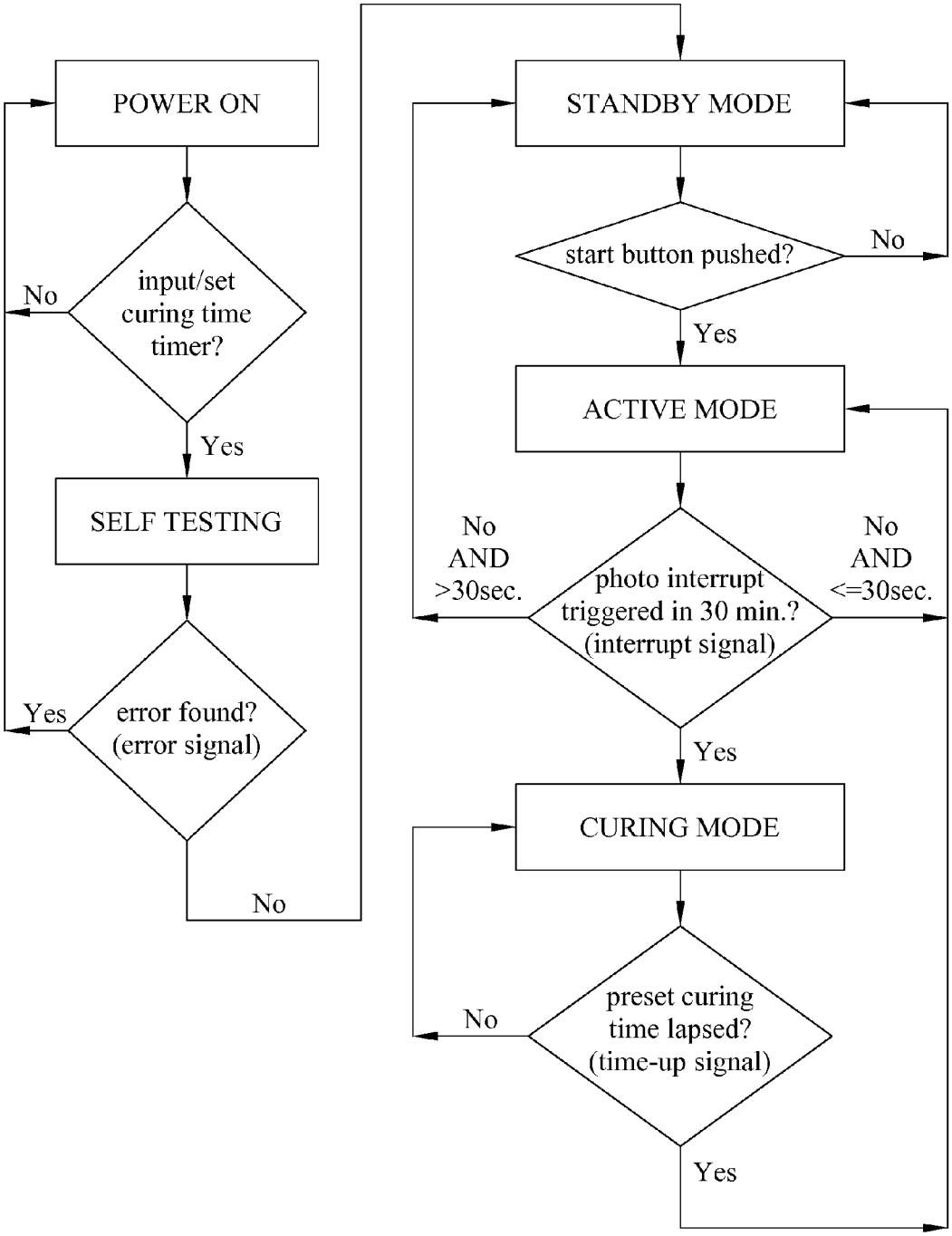
FIG. 6 shows another illustrative functional block diagram of a switch controller of the UV LED curing apparatus according to another embodiment of the present invention.

A more advanced automatic switch controller may too be further integrated into the apparatus of the present invention. FIG. 6 shows another explanatory logical chart of a switch controller of the UV LED curing apparatus of the present invention. Prior to the entering of the abovementioned standby mode in which the apparatus is powered and ready to be activated for UV light curing, the apparatus may further include a "self-testing" mode such that the components of the apparatus and the electrical connections therebetween may be tested prior to the start mode. As power is supplied to the apparatus, the user may first be prompted to enter a desired curing time such as any length of curing time preferably between 5 and 30 seconds. Such curing time is preset into the timer and current regulator of the switch controller and may be used as a reference to the abovementioned second input signal or time-up signal by the apparatus as the preset curing time lapses during the curing mode of the apparatus. Once the desired curing time is inputted by the user, the apparatus may then enter into a self-testing mode in such the switch controller performs a test on the apparatus checking all electrical connections between all components including for example, the UV LED light source and photo interrupt module. As no error or error signals may be detected or bounced back, the switch controller may then allow and set the apparatus to be at the abovementioned standby mode. In a preferred embodiment, the feature of self-testing may be achieved by the use of microprocessor and firmware; in another embodiment, it may be achieved by the use of electronic components such as resistors and capacitors and preferably without the use of microprocessor.

Furthermore, in a preferred embodiment of the present invention, the switch controller may further comprise a pulse-width modulation/PWM electrically connected to the power supply to increment the amount of electrical power between fully on and fully off. In other words, an advanced PWM may be further provided to allow the UV curing apparatus of the present invention to be turned on at the peak value of power input or of an adjustable UV lighting.

As the UV LED curing apparatus of the present invention is capable of providing an effective and safe curing of UV LED lighting on an UV hardening gel with automatic switch controls while having an improved mechanical structure or housing, it can be understood that the utilization of the UV curing apparatus with or without any UV hardening gel in the application of the nails of human hands and feet shall too be within the scope of the present invention. Examples of UV hardening gel, such as an acrylic type gel, including urethane-methacrylate and epoxy-methacrylate from manufacturers such as Keystone®, BIO®, CNC®, COSMEX®. The introduction of an UV LED kit including the UV curing apparatus of the present invention and any UV hardening gel shall too be considered to be within the scope of the present invention.

While the present invention is disclosed in reference to the preferred embodiments or examples above, it is to be understood that these embodiments or examples are intended for illustrative purposes, which shall not be treated as limitations to the present invention. It is contemplated that modifications and combinations will readily occur to those skilled in the art, which modifications and combinations will be within the spirit of the invention and the scope of the following claims.

What is claimed is:

1. An UV LED curing apparatus, comprising:

a light reflective inner casing having a light reflective inner wall enclosing an inner chamber and an outer wall; wherein the inner chamber includes at least one front opening facing toward a front side of the apparatus; and wherein said inner casing provides a support structure for affixing an UV LED light source;

an outer casing detachably attached to the outer wall of the inner casing; said outer casing and said inner casing defining a space suitable for affixing said UV LED light source to said inner casing;

said UV LED light source comprising at least one UV LED module affixed to the inner casing and having a light emitting side facing toward the inner chamber thereof;

a switch controller comprising at least one button, a substrate and a photo interrupt module, said switch controller attached to the inner casing and electrically connected to the UV LED light source; and said photo interrupt module located at the inner wall of the inner casing; wherein the substrate further comprises a timer, a current regulator integrated thereon;

whereby the switch controller controls an on-off state of the UV LED light source with reference to a first input signal received from and triggered by said photo interrupt module to turn on the UV LED light source and with reference to a second input signal received from the timer and the current regulator to turn off the UV LED light source; and whereby the light reflective inner wall of the inner casing directs and reflects UV light emitted from the UV LED light source within the inner chamber thereof.

2. The UV LED curing apparatus as claimed in claim 1, wherein the outer casing further comprises a bottom plate detachably attached to the inner casing.

3. The UV LED curing apparatus as claimed in claim 1, wherein the outer wall of the inner casing further comprises at least one aperture to receive the at least one UV LED module of the UV LED light source therein.

4. The UV LED curing apparatus as claimed in claim 1, wherein the inner wall of the inner casing comprises a plurality of planes angled from one another at an angle between 90 degree and 175 degree.

5. The UV LED curing apparatus as claimed in claim 1, wherein the outer casing further comprises at least one heat dissipating means disposed between the outer casing and the inner casing for dissipating heat generated by the UV LED light source away therefrom.

6. The UV LED curing apparatus as claimed in claim 5, wherein the heat dissipating means is a rotary fan electrically connected to the switch controller and activated by said first input signal from the photo interrupt module.

7. The UV LED curing apparatus as claimed in claim 1, wherein the outer casing is detachably attached to the outer wall of the inner casing by any one of the following fixation means including screws, bolts and magnets.

8. The UV LED curing apparatus as claimed in claim 2, wherein the bottom cover of outer casing is detachably attached to the inner casing by any one of the following fixation means including screws, bolts and magnets.

9. The UV LED curing apparatus as claimed in claim 1, wherein the UV LED light source is of a short wavelength between 360 nm and 460 nm.

10. The UV LED curing apparatus as claims in claim 1, wherein the at least one UV LED module of the UV LED light source further comprises a collimator attached to the light emitting side thereof.

11. The UV LED curing apparatus as claimed in claim 1, wherein the photo interrupt module of the switch controller further comprises at least one sensor emitter having an active side facing toward the front opening of the inner chamber of the inner casing and wherein the photo interrupt module is triggered with reference to an interrupt signal from the at least one sensor emitter.

12. The UV LED curing apparatus as claimed in claim 1, wherein the switch controller is attached to the inner casing and configured on a rear side of the apparatus opposite to said front side thereof and away from the front opening of the inner chamber of the inner casing.

13. The UV LED curing apparatus as claimed in claim 1, wherein the switch controller further comprises a PWM electrically connected to the timer and the current regulator.

14. The UV LED curing apparatus as claimed in claim 1, wherein the switch controller is at an active mode continuous for a predetermined period of active time for the photo interrupt module to be triggered to send said first input signal to the timer and the current regulator thereof to turn on the UV LED light source and to switch to a curing mode; and wherein the switch controller is returned from the curing mode to the active mode after a predetermined period of curing time is lapsed and said second input signal is received from the timer and the current regulator thereof to turn off the UV LED light source.

15. The UV LED curing apparatus as claimed in claim 14, wherein the predetermined period of curing time is referenced to a clock circuitry preset in the timer and is of a length greater than 5 seconds.

16. An UV LED curing apparatus, comprising:

a housing comprising an inner casing enclosing an inner chamber and an outer casing detachably attached to the inner casing; wherein the inner chamber further comprises at least one front opening formed on a front side of the housing; wherein said inner casing provides a support structure for affixing an UV LED light source; and wherein said outer casing and said inner casing define a space suitable for affixing said UV LED light source to said inner casing;

a reflector comprising a plurality of light reflective planes angled from one another and a plurality of apertures formed thereon, attached to the inner casing and fitted to the inner chamber of the housing;

said UV LED light source comprising at least one UV LED module affixed to the inner casing and positioned within the plurality of apertures of the reflector, having a light emitting side facing toward the inner chamber of the housing;

a switch controller comprising at least one button, a substrate and a photo interrupt module, said switch controller attached to the inner casing and electrically connected to the UV LED light source; and said photo interrupt module located at the inner wall of the inner casing; wherein the substrate further comprises a timer, a current regulator integrated thereon;

a power supply comprising at one rechargeable battery, electrically connected to the UV LED light source and the switch controller and enclosed by the outer casing;

whereby the switch controller controls an on-off state of the UV LED light source with reference to a first input signal received from and triggered by said photo interrupt module to turn on the UV LED light source and with reference to a second input signal received from the timer and the current regulator to turn off the UV LED light source; and whereby the plurality of light reflective planes of the reflector directs and reflects UV light emitted from the UV LED light source within the inner chamber thereof.

17. The UV LED curing apparatus as claimed in claim 16, wherein the plurality of light reflective planes angled from one another of the reflector are at an angle between 90 degree and 175 degree.

18. The UV LED curing apparatus as claimed in claim 16, wherein the outer casing further comprises at least one heat dissipating fan electrically connected to the power supply and activated by the switch controller, disposed between the outer casing and the inner casing for dissipating heat generated by the UV LED light source away therefrom.

19. The UV LED curing apparatus as claimed in claim 16, wherein the outer casing is detachably attached to the inner casing of the housing by any one of the following fixation means including screws, bolts and magnets.

20. The UV LED curing apparatus as claimed in claim 16, wherein the switch controller is at an active mode continuous for a predetermined period of active time for the photo interrupt module to be triggered to send said first input signal to the timer and the current regulator thereof to turn on the UV LED light source and to switch to a curing mode; and wherein the switch controller is returned from the curing mode to the active mode after a predetermined period of curing time is lapsed and said second input signal is received from the timer and the current regulator thereof to turn off the UV LED light source.

* * * * *